US010438552B2

(12) United States Patent
Jiang

(10) Patent No.: US 10,438,552 B2
(45) Date of Patent: Oct. 8, 2019

(54) LIQUID CRYSTAL DISPLAY PANEL AND DEVICE

(71) Applicant: SHENZHEN CHINA STAR OPTOELECTRONICS TECHNOLOGY CO., LTD., Shenzhen, Guangdong (CN)

(72) Inventor: Xiangwei Jiang, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 74 days.

(21) Appl. No.: 15/546,945

(22) PCT Filed: May 3, 2017

(86) PCT No.: PCT/CN2017/082812

§ 371 (c)(1),
(2) Date: Jul. 27, 2017

(87) PCT Pub. No.: WO2018/176565

PCT Pub. Date: Oct. 4, 2018

(65) Prior Publication Data

US 2018/0286338 A1 Oct. 4, 2018

(30) Foreign Application Priority Data

Apr. 1, 2017 (CN) ..... 2017 1 0212754

(51) Int. Cl.
*G09G 3/36* (2006.01)

(52) U.S. Cl.
CPC ... *G09G 3/3655* (2013.01); *G09G 2300/0426* (2013.01); *G09G 2300/0447* (2013.01); *G09G 2320/0204* (2013.01); *G09G 2320/0223* (2013.01); *G09G 2320/0233* (2013.01)

(58) Field of Classification Search
CPC ..... G09G 3/3655; G09G 2320/0204; G09G 2320/0233
See application file for complete search history.

(56) References Cited

U.S. PATENT DOCUMENTS

2003/0002002 A1* 1/2003 Kawachi ..... G02F 1/134363 349/143
2008/0136982 A1* 6/2008 Watanabe ..... G02F 1/133371 349/37
2008/0165302 A1* 7/2008 Yasui ..... G09G 3/3648 349/48
2009/0128723 A1* 5/2009 Saito ..... G09G 3/3655 349/37
2010/0073337 A1* 3/2010 Tsubata ..... G02F 1/133707 345/204

(Continued)

*Primary Examiner* — Ibrahim A Khan
(74) *Attorney, Agent, or Firm* — Hauptman Ham, LLP

(57) ABSTRACT

The present disclosure provides a liquid crystal display panel and a device, which comprises a data line, a scanning line, a first common line, a second common line, a main-pixel portion, and a sub-pixel portion. The first common line is for supplying a common voltage, the second common is for making a voltage of the sub-pixel portion equal to a fixed value and a voltage of the main-pixel portion is different from the voltage of the sub-pixel portion when the liquid crystal display panel is aligned.

16 Claims, 2 Drawing Sheets

(56) References Cited

U.S. PATENT DOCUMENTS

2010/0182523 A1* 7/2010 Woo ..... G02F 1/134363 349/37
2010/0277453 A1* 11/2010 Wang ..... G09G 3/344 345/211
2011/0102697 A1* 5/2011 Koyama ..... G02F 1/13454 349/43
2011/0193769 A1* 8/2011 Ohgami ..... G02F 1/134309 345/87
2012/0154716 A1* 6/2012 Kaise ..... G02F 1/134336 349/85
2012/0169694 A1* 7/2012 Chuang ..... G09G 3/3655 345/211
2013/0033439 A1* 2/2013 Kim ..... G02F 1/13338 345/173
2013/0076721 A1* 3/2013 Al-Dahle ..... G09G 3/3655 345/212
2013/0106839 A1* 5/2013 Kim ..... H04N 13/337 345/419
2013/0300989 A1* 11/2013 Hibayashi ..... G02F 1/133512 349/108
2014/0009457 A1* 1/2014 Wu ..... G02F 1/13306 345/212
2014/0340603 A1* 11/2014 Hu ..... G02F 1/136227 349/43
2014/0340622 A1* 11/2014 Ono ..... G02F 1/134363 349/138
2015/0002497 A1* 1/2015 Dong ..... G09G 3/3655 345/211
2015/0234244 A1* 8/2015 Tsuchiya ..... G02F 1/134363 349/96
2017/0229090 A1* 8/2017 Zhang ..... G09G 5/003

* cited by examiner

LIQUID CRYSTAL DISPLAY PANEL AND DEVICE

CROSS-REFERENCE TO RELATED APPLICATIONS

This application is a National Phase Application of PCT International Application No. PCT/CN2017/082812, which was filed on May 3, 2017, and which claims priority from Chinese Patent Application No. 201710212754.7 filed with the State Intellectual Property Office on Apr. 1, 2017. The disclosures of the above patent applications are incorporated herein by reference in their entirety.

BACKGROUND OF THE INVENTION

Field of Invention

The present disclosure relates to the field of liquid crystal display technology, and particularly to a liquid crystal display panel and a device.

Description of Prior Art

Gate driver On Array (GOA) is the use of existing manufacturing processes of thin film transistor liquid crystal display array substrates to manufacture the scan-driving signal circuit of gate lines on the array substrate, to achieve progressive scan-driving on gate lines.

With the improvement on fineness of LCD panels, the pixel size is getting smaller and smaller; the pixel aperture rate is getting smaller accordingly, thus affecting the display brightness.

As FIG. 1 shows, in order to raise the display brightness, the conventional display panel comprises a main-pixel portion 101, a sub-pixel portion 102 and three thin film transistors T1-T3, gate electrodes of the thin film transistors T1-T3 are connected to a scanning line 12, source electrodes of the thin film transistors T1, T2 are connected to a data line 11, and the source electrode of the thin film transistor T3 is connected to a common line 13 through the deep-shallow hole. Where an internal resistance of the thin film transistor T3 is much smaller than an internal resistance of the thin film transistor T2, the size of the thin film transistor T3 is smaller than that of the thin film transistor T2. The potential of the sub-pixel portion 102 is lower than the potential of the main-pixel portion 101 by a function of the partial pressure of the resistances in the thin film transistors T2, T3, eight display domains are realized, further, the viewing angle is increased.

However, in the actual manufacturing process, the resistance fineness of the internal resistance of the thin film transistor T3 and the resistance of the deep-shallow hole are hard to control due to several effects caused by the film thickness, exposure process, and etching process. Hence, the internal resistance of the thin film transistor T3 and the resistance of the deep-shallow hole easily fluctuate, resulting in the subpixel unit 102 having an uneven voltage, and the alignment of the sub-pixel portion 102 tends to be uneven, hence, the display effect is reduced.

Therefore, it is necessary to provide a liquid crystal display panel and a device to solve the problems existing in the conventional art.

SUMMARY OF THE INVENTION

The objective of the present disclosure is to provide a liquid crystal display panel and a device to raise the display effect.

In order to solve the above technical problem, the present disclosure provides a liquid crystal display panel, which comprises a data line, a scanning line, a first common line, a second common line, a main-pixel portion, and a sub-pixel portion. The first common line is for supplying a common voltage, the second common line is for making a voltage of the sub-pixel portion equal to a fixed value and a voltage of the main-pixel portion is different from the voltage of the sub-pixel portion, when the liquid crystal display panel is aligned. The voltage of the sub-pixel portion is obtained by a voltage inputted according to the second common line.

The main-pixel portion comprises a first thin film transistor and a first pixel electrode. The first thin film transistor comprises a first gate electrode, a first source electrode and a first drain electrode. The first gate electrode is connected to the scanning line. The source electrode is connected to the data line. The first drain electrode is connected to the first pixel electrode.

The sub-pixel portion comprises a second thin film transistor, a third thin film transistor and a second pixel electrode. The second thin film transistor comprises a second gate electrode, a second source electrode, and a second drain electrode. The third thin film transistor comprises a third gate electrode, a third source electrode, and a third drain electrode. The second gate electrode and the third gate electrode are connected to the scanning line. The second source electrode is connected to the data line. The second drain electrode is connected to the third drain electrode. The third drain electrode is connected to the second pixel electrode. The third source electrode is connected to the second common line.

In the liquid crystal display panel of the present disclosure, when the liquid crystal display panel is aligned, the voltage inputted by the second common line is equal to a voltage inputted from the data line, and the voltage inputted by the second common line is not equal to the voltage inputted by the first common line.

In the liquid crystal display panel of the present disclosure, the second common line and the data line are grounded.

In the liquid crystal display panel of the present disclosure, the voltage inputted by the second common line is equal to the voltage inputted by the first common line, when the liquid crystal display panel is displayed or the liquid crystal display panel is tested.

In the liquid crystal display panel of the present disclosure, the voltage of the sub-pixel portion is as below:

$$V\text{sub}''=R2/(R2+R3+R4)*V\text{Com}2$$

VCom2 is the voltage inputted by the second common line. R1-R3 are respectively represented as internal resistors of the first thin film transistor, the second thin film transistor, and the third thin film transistor. R4 is represented as internal resistor of a deep-shallow hole. Vsub" is represented as the voltage of the sub-pixel portion.

The present disclosure provides a liquid crystal display panel, which comprises a data line, a scanning line, a first common line, a second common line, a main-pixel portion, and a sub-pixel portion. The first common line is for supplying a common voltage, the second common line is for making a voltage of the sub-pixel portion equal to a fixed value and a voltage of the main-pixel portion is different from the voltage of the sub-pixel portion, when the liquid crystal display panel is aligned.

In the liquid crystal display panel of the present disclosure, the main-pixel portion comprises a first thin film transistor and a first pixel electrode. The first thin film transistor comprises a first gate electrode, a first source electrode and a first drain electrode. The first gate electrode is connected to the scanning line. The source electrode is connected to the data line. The first drain electrode is connected to the first pixel electrode.

The sub-pixel portion comprises a second thin film transistor, a third thin film transistor, and a second pixel electrode. The second thin film transistor comprises a second gate electrode, a second source electrode, and a second drain electrode. The third thin film transistor comprises a third gate electrode, a third source electrode, and a third drain electrode. The second gate electrode and the third gate electrode are connected to the scanning line. The second source electrode is connected to the data line. The second drain electrode is connected to the third drain electrode. The third drain electrode is connected to the second pixel electrode. The third source electrode is connected to the second common line.

In the liquid crystal display panel of the present disclosure, when the liquid crystal display panel is aligned, the voltage inputted by the second common line is equal to a voltage inputted from the data line, and the voltage inputted by the second common line is not equal to the voltage inputted by the first common line.

In the liquid crystal display panel of the present disclosure, the second common line and the data line are grounded.

In the liquid crystal display panel of the present disclosure, the voltage of the sub-pixel portion is obtained by a voltage inputted according to the second common line.

In the liquid crystal display panel of the present disclosure, the voltage inputted by the second common line is equal to the voltage inputted by the first common line, when the liquid crystal display panel is displayed or the liquid crystal display panel is tested.

The present disclosure provides a liquid crystal display device which comprises a back-light module and a liquid crystal display panel. The liquid crystal display panel comprises a data line, a scanning line, a first common line, a second common line, a main-pixel portion, and a sub-pixel portion. The first common line is for supplying a common voltage, the second common line is for making a voltage of the sub-pixel portion equal to a fixed value and a voltage of the main-pixel portion is different from the voltage of the sub-pixel portion, when the liquid crystal display panel is aligned.

In the liquid crystal display device of the present disclosure, the main-pixel portion comprises a first thin film transistor and a first pixel electrode. The first thin film transistor comprises a first gate electrode, a first source electrode, and a first drain electrode. The first gate electrode is connected to the scanning line. The source electrode is connected to the data line. The first drain electrode is connected to the first pixel electrode.

The sub-pixel portion comprises a second thin film transistor, a third thin film transistor, and a second pixel electrode. The second thin film transistor comprises a second gate electrode, a second source electrode, and a second drain electrode. The third thin film transistor comprises a third gate electrode, a third source electrode, and a third drain electrode. The second gate electrode and the third gate electrode are connected to the scanning line. The second source electrode is connected to the data line. The second drain electrode is connected to the third drain electrode. The third drain electrode is connected to the second pixel electrode. The third source electrode is connected to the second common line.

In the liquid crystal display device of the present disclosure, when the liquid crystal display panel is aligned, the voltage inputted by the second common line is equal to a voltage inputted from the data line, and the voltage inputted by the second common line is not equal to the voltage inputted by the first common line.

In the liquid crystal display device of the present disclosure, the second common line and the data line are grounded.

In the liquid crystal display device of the present disclosure, the voltage of the sub-pixel portion is obtained by a voltage inputted according to the second common line.

In the liquid crystal display device of the present disclosure, the voltage inputted by the second common line is equal to the voltage inputted by the first common line, when the liquid crystal display panel is displayed or the liquid crystal display panel is tested.

In the present disclosure, the liquid crystal display panel and the device keep the voltage of the sub-pixel portion constant during alignment process with adding additional common lines, the voltage unevenness of the sub-pixel portion is avoided to make the alignment be more even, the display effect raised accordingly.

DETAILED DESCRIPTION OF THE PREFERRED EMBODIMENTS

Figure 1:
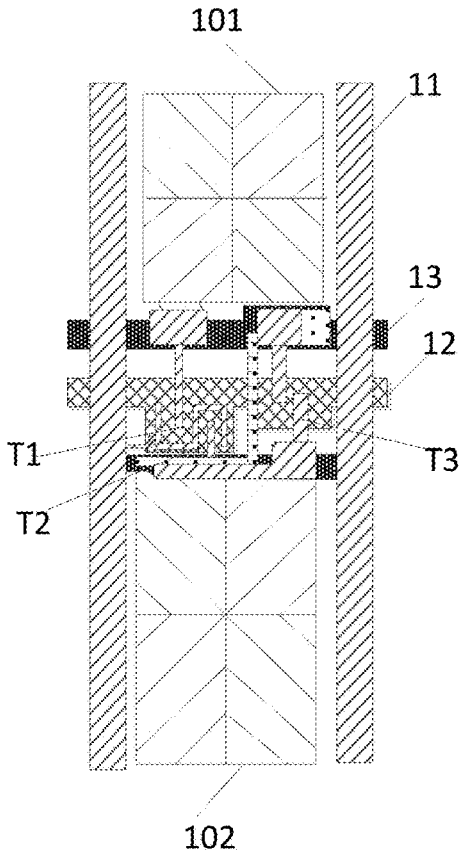
FIG. 1 is a schematic illustrative drawing of a conventional liquid crystal display panel.

The following description of the embodiments is directed to the attached drawings for illustrating specific embodiments in which the disclosure may be practiced. The terms of the present disclosure, such as "up", "down", "front", "post", "left", "right", "inside", "outside", "side", are merely directions referring to attached drawings. Thus, the directional language used is for the purpose of illustrating and understanding the invention and is not intended to be limiting of the invention. In the figure, units with similar structures are denoted by the same reference numerals.

Figure 2:
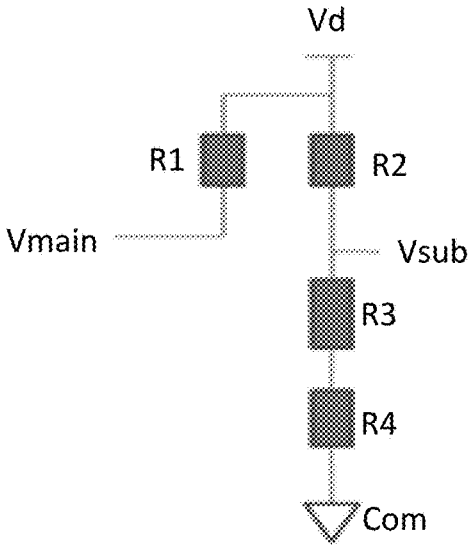
FIG. 2 is an equivalent circuit diagram of a conventional liquid crystal display panel.

FIG. 2 is an equivalent circuit diagram of a conventional liquid crystal display panel.

As shown in FIG. 2, the electrical principle of the conventional liquid crystal display panel is as follows: when the scanning line 12 is opened, the thin film transistors T2, T3 are turned on, and the internal resistance of the thin film transistors T2, T3 and the resistance of the deep-shallow hole constitute a voltage dividing circuit.

In the display process, the voltage of the sub-pixel portion 102 is as shown in Equation 1:

$$V\text{sub}=(R3+R4)/(R2+R3+R4)*V\text{main} \qquad \text{Equation 1}$$

R1-R3 are respectively represented as internal resistors of the first thin film transistor T1, the second thin film transistor T2 and the third thin film transistor T3. R4 is represented as internal resistor of a deep-shallow hole. Vsub is represented as the voltage of the sub-pixel portion 102. Vmain is represented as the voltage of the main-pixel portion 101.

When the HVA light alignment, the voltage VCom of the common line 13 is AC voltage, such as amplitude of the voltage VCom is 12 Volts. The data line 11 is grounded, the voltage of the data line is Vd, meanwhile, the voltage Vsub' of the sub-pixel portion 102 is as shown in Equation 2:

$$V\text{sub}'=R2/(R2+R3+R4)*V\text{Com} \qquad \text{Equation 2}$$

However, the actual manufacturing process is limited by the processes such as film formation, exposure process, and etching process, so that there are differences among the internal resistances R3, R4 in different regions of the display panel, resulting in differences among the voltages of the sub-pixel portion 102, hence, the aligning voltages of the sub-pixel portion 102 of the different regions are different, resulting in poor alignment.

Figure 3:
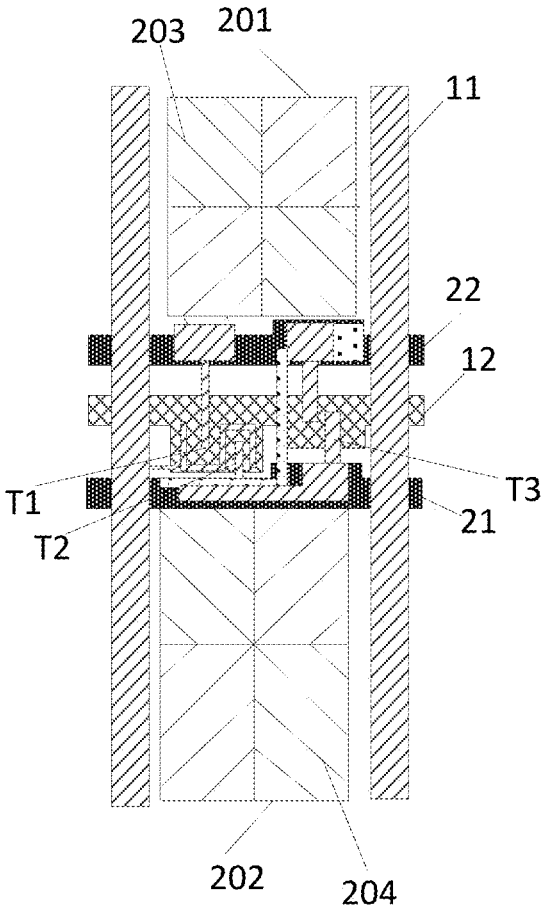
FIG. 3 is a schematic illustrative drawing of a liquid crystal display panel according to the present disclosure.

FIG. 3 is a schematic illustrative drawing of a liquid crystal display panel according to the present disclosure. As shown in FIG. 3, the liquid crystal display panel of the present disclosure comprises a data line 11, a scanning line 12, a first common line 21, and a second common line 22. The liquid crystal display panel further comprises a main-pixel portion 201 and a sub-pixel portion 202.

The data line 11 is for inputting a data signal; the scanning line 12 is for inputting a scanning signal. The first common line 21 is for supplying a common voltage VCom1, the second common line 22 is for making a voltage of the sub-pixel portion 202 equal to a fixed value, in other words, keeping the voltage of the sub-pixel portion constant. The first common line 21 and the second common line 22 can be derived by patterning to the same metal layer. A voltage of the main-pixel portion 201 is different from the voltage of the sub-pixel portion 202.

In one embodiment, the main-pixel portion 201 comprises a first thin film transistor T1 and a first pixel electrode 203. The first thin film transistor T1 comprises a first gate electrode, a first source electrode, and a first drain electrode. The first gate electrode is connected to the scanning line 12. The source electrode is connected to the data line 11. The first drain electrode is connected to the first pixel electrode 203.

The sub-pixel portion 202 comprises a second thin film transistor T2, a third thin film transistor T3, and a second pixel electrode 204. The second thin film transistor T2 comprises a second gate electrode, a second source electrode, and a second drain electrode. The third thin film transistor T3 comprises a third gate electrode, a third source electrode, and a third drain electrode. The second gate electrode and the third gate electrode are connected to the scanning line 12. The second source electrode is connected to the data line 11. The second drain electrode is connected to the third drain electrode. The third drain electrode is connected to the second pixel electrode 204. The third source electrode is connected to the second common line 22.

When the liquid crystal display panel is aligned, the first common line 21 is inputted by an AC voltage, and the amplitude of the AC voltage is 12 Volts. The voltage inputted by the second common line 21 is equal to a voltage inputted from the data line 11, and the voltage inputted by the second common line 22 is not equal to the voltage inputted by the first common line 12. Furthermore, the second common line 22 and the data line 11 are grounded.

Meanwhile, the voltage Vsub" of the sub-pixel portion 202 is as equation 3:

$$V\text{sub}''=R2/(R2+R3+R4)*V\text{Com2} \qquad \text{Equation 3}$$

VCom2 is the voltage inputted by the second common line 22. R1-R3 are respectively represented as internal resistors of the first thin film transistor T1, the second thin film transistor T2 and the third thin film transistor T3. R4 is represented as internal resistor of a deep-shallow hole. Vsub" is represented as the voltage of the sub-pixel portion 102. In other words, the voltage of the sub-pixel portion 202 is obtained by a voltage inputted according to the second common line 22.

Since the second common line 22 is grounded, the voltage of Vsub" is equal to the ground voltage, that is, the voltage of the sub-pixel portion 202 is fixed, then, the voltage differences among the sub-pixel portions are uniform and are no longer affected by the internal resistances of the thin film transistors and the internal resistance of the deep-shallow hole, making the aligning voltages of the sub-pixel portion 202 of the entire liquid crystal display panel be the same, and the alignment defect is eliminated.

The voltage inputted by the second common line 22 is equal to the voltage inputted by the first common line 21, when the liquid crystal display panel is displayed or the liquid crystal display panel is tested, in other words, VCom2 is equal to VCom1. Specifically, the first common line 21 and the second common line 22 are electrically connected with each other during the display process or the testing process of the panel.

In the present disclosure, the liquid crystal display panel keeps the voltage of the sub-pixel portion constant during alignment process with adding additional common lines, to avoid the influences on the internal resistance of the third thin film transistor T3 and the resistance of the deep-shallow hole caused by the manufacturing process, hence, the voltage unevenness of the sub-pixel portion is avoided to make the alignment be more even, the display effect is raised accordingly.

The present disclosure further provides a liquid display device, which comprises a back-light module and a liquid crystal display panel, as shown in FIG. 3, the liquid crystal display panel comprises a data line 11, a scanning line 12, a first common line 21, and a second common line 22. The liquid crystal display panel further comprises a main-pixel portion 201 and a sub-pixel portion 202.

The data line 11 is for inputting a data signal; the scanning line 12 is for inputting a scanning signal. The first common line 21 is for supplying a common voltage VCom1, the second common line 22 is for making a voltage of the sub-pixel portion 202 equal to a fixed value, in other words, keeping the voltage of the sub-pixel portion constant. The first common line 21 and the second common line 22 can be derived by patterning to the same metal layer. A voltage of the main-pixel portion 201 is different from the voltage of the sub-pixel portion 202.

In one embodiment, the main-pixel portion 201 comprises a first thin film transistor T1 and a first pixel electrode 203. The first thin film transistor T1 comprises a first gate electrode, a first source electrode, and a first drain electrode. The first gate electrode is connected to the scanning line 12. The source electrode is connected to the data line 11. The first drain electrode is connected to the first pixel electrode 203.

The sub-pixel portion 202 comprises a second thin film transistor T2, a third thin film transistor T3, and a second pixel electrode 204. The second thin film transistor T2 comprises a second gate electrode, a second source electrode, and a second drain electrode. The third thin film transistor T3 comprises a third gate electrode, a third source electrode, and a third drain electrode. The second gate electrode and the third gate electrode are connected to the scanning line 12. The second source electrode is connected to the data line 11. The second drain electrode is connected to the third drain electrode. The third drain electrode is connected to the second pixel electrode 204. The third source electrode is connected to the second common line 22.

When the liquid crystal display panel is aligned, the first common line 21 is inputted by an AC voltage, and the amplitude of the AC voltage is 12 Volts. The voltage inputted by the second common line 21 is equal to a voltage inputted from the data line 11, and the voltage inputted by the second common line 22 is not equal to the voltage inputted by the first common line 12. Furthermore, the second common line 22 and the data line 11 are grounded.

Meanwhile, the voltage Vsub" of the sub-pixel portion 202 is as equation 3:

$$V\text{sub}''=R2/(R2+R3+R4)*V\text{Com2} \quad \text{Equation 3}$$

VCom2 is the voltage inputted by the second common line 22. R1-R3 are respectively represented as internal resistors of the first thin film transistor T1, the second thin film transistor T2, and the third thin film transistor T3. R4 is represented as internal resistor of a deep-shallow hole. Vsub" is represented as the voltage of the sub-pixel portion 102. In other words, the voltage of the sub-pixel portion 202 is obtained by a voltage inputted according to the second common line 22.

Since the second common line 22 is grounded, the voltage of Vsub" is equal to the ground voltage, that is, the voltage of the sub-pixel portion 202 is fixed, then, the voltage differences among the sub-pixel portions are uniform and are no longer affected by the internal resistances of the thin film transistors and the internal resistance of the deep-shallow hole, making the aligning voltages of the sub-pixel portion 202 of the entire liquid crystal display panel be the same, and the alignment defect is eliminated.

The voltage inputted by the second common line 22 is equal to the voltage inputted by the first common line 21, when the liquid crystal display panel is displayed or the liquid crystal display panel is tested, in other words, VCom2 is equal to VCom1. Specifically, the first common line 21 and the second common line 22 are electrically connected with each other during the display process or the testing process of the panel.

In the present disclosure, the liquid crystal display device keeps the voltage of the sub-pixel portion constant during alignment process with adding additional common lines, to avoid the influences on the internal resistance of the third thin film transistor T3 and the resistance of the deep-shallow hole caused by the manufacturing process, hence, the voltage unevenness of the sub-pixel portion is avoided to make the alignment more even, and the display effect is raised accordingly.

Although the present disclosure comprises been disclosed as preferred embodiments, the foregoing preferred embodiments are not intended to limit the present disclosure. Those of ordinary skill in the art, without departing from the spirit and scope of the present disclosure, can make various kinds of modifications and variations to the present disclosure. Therefore, the scope of the claims of the present disclosure must be defined.

What is claimed is:

1. A liquid crystal display panel, comprising a data line, a scanning line, a first common line, a second common line, a main-pixel portion, and a sub-pixel portion; the first common line being for supplying a common voltage, the second common line being for making a voltage of the sub-pixel portion equal to a fixed value and a voltage of the main-pixel portion is different from the voltage of the sub-pixel portion when the sub-pixel portion is applied with the voltage; the voltage of the sub-pixel portion is obtained by a voltage inputted according to the second common line;

wherein the main-pixel portion comprises a first thin film transistor and a first pixel electrode, the first thin film transistor comprises a first gate electrode, a first source electrode, and a first drain electrode, the first gate electrode is connected to the scanning line, the source electrode is connected to the data line, and the first drain electrode is connected to the first pixel electrode;

wherein the sub-pixel portion comprises a second thin film transistor, a third thin film transistor, and a second pixel electrode, the second thin film transistor comprises a second gate electrode, a second source electrode, and a second drain electrode, the third thin film transistor comprises a third gate electrode, a third source electrode, and a third drain electrode, the second gate electrode and the third gate electrode are connected to the scanning line, the second source electrode is connected to the data line, the second drain electrode is connected to the third drain electrode, the third drain electrode is connected to the second pixel electrode, and the third source electrode is connected to the second common line; and wherein the voltage of the sub-pixel portion is as below:

$$V\text{sub}''=R2/(R2+R3+R4)*V\text{Com2}$$

wherein VCom2 is the voltage inputted by the second common line, R1-R3 are respectively represented as internal resistors of the first thin film transistor, the second thin film transistor and the third thin film transistor, R4 is represented as internal resistor of a deep-shallow hole, Vsub" is represented as the voltage of the sub-pixel portion.

2. The liquid crystal display panel according to claim 1, wherein:

when the liquid crystal display panel is aligned, the voltage inputted by the second common line is equal to a voltage inputted from the data line, and the voltage inputted by the second common line is not equal to the voltage inputted by the first common line.

3. The liquid crystal display panel according to claim 2, wherein the second common line and the data line are grounded.

4. The liquid crystal display panel according to claim 1, wherein the voltage inputted by the second common line is equal to the voltage inputted by the first common line, when the liquid crystal display panel is displayed or the liquid crystal display panel is tested.

5. A liquid crystal display panel, comprising: a data line, a scanning line, a first common line, a second common line, a main-pixel portion, and a sub-pixel portion; the first common line being for supplying a common voltage, the second common line being for making a voltage of the sub-pixel portion equal to a fixed value and a voltage of the main-pixel portion is different from the voltage of the sub-pixel portion when the sub-pixel portion is applied with the voltage, wherein the voltage of the sub-pixel portion is as below:

$$V\text{sub}''R2/(R2+R3+R4)*V\text{Com2}$$

wherein VCom2 is the voltage inputted by the second common line, R1-R3 are respectively represented as internal resistors of the first thin film transistor, the second thin film transistor and the third thin film transistor, R4 is represented as internal resistor of a deep-shallow hole, Vsub" is represented as the voltage of the sub-pixel portion.

6. The liquid crystal display panel according to claim 5, wherein the main-pixel portion has a first thin film transistor and a first pixel electrode, the first thin film transistor has a first gate electrode, a first source electrode and a first drain electrode, the first gate electrode is connected to the scanning line, the source electrode is connected to the data line, and the first drain electrode is connected to the first pixel electrode;

the sub-pixel portion has a second thin film transistor, a third thin film transistor and a second pixel electrode, the second thin film transistor has a second gate electrode, a second source electrode, and a second drain electrode, the third thin film transistor has a third gate electrode, a third source electrode, and a third drain electrode, the second gate electrode and the third gate electrode are connected to the scanning line, the second source electrode is connected to the data line, the second drain electrode is connected to the third drain electrode, the third drain electrode is connected to the second pixel electrode, and the third source electrode is connected to the second common line.

7. The liquid crystal display panel according to claim 5, wherein:

when the liquid crystal display panel is aligned, the voltage inputted by the second common line is equal to a voltage inputted from the data line, and the voltage inputted by the second common line is not equal to the voltage inputted by the first common line.

8. The liquid crystal display panel according to claim 7, Wherein the second common line and the data line are grounded.

9. The liquid crystal display panel according to claim 5, wherein the voltage of the sub-pixel portion is obtained by a voltage inputted according to the second common line.

10. The liquid crystal display panel according to claim 5, wherein the voltage inputted by the second common line is equal to the voltage inputted by the first common line when the liquid crystal display panel is displayed or the liquid crystal display panel is tested.

11. A liquid crystal display device, comprising:

a back-light module; and a liquid crystal display panel, comprising: a data line, a scanning line, a first common line, a second common line, a main-pixel portion, and a sub-pixel portion; the first common line being for supplying a common voltage, the second common line being for making a voltage of the sub-pixel portion equal to a fixed value and a voltage of the main-pixel portion is different from the voltage of the sub-pixel portion when the sub-pixel portion is applied with the voltage; and wherein the voltage of the sub-pixel portion is as below:

$$V\text{sub}''=R2/(R2+R3\pm R4)*V\text{Com}2$$

wherein VCom2 is the voltage inputted by the second common line, R1-R3 are respectively represented as internal resistors of the first thin film transistor, the second thin film transistor and the third thin film transistor, R4 is represented as internal resistor of a deep-shallow hole, Vsub" is represented as the voltage of the sub-pixel portion.

12. The liquid crystal display device according to claim 11, wherein the main-pixel portion has a first thin film transistor and a first pixel electrode, the first thin film transistor has a first gate electrode, a first source electrode, and a first drain electrode, the first gate electrode is connected to the scanning line, the source electrode is connected to the data line, the first drain electrode is connected to the first pixel electrode;

the sub-pixel portion has a second thin film transistor, a third thin film transistor, and a second pixel electrode, the second thin film transistor has a second gate electrode, a second source electrode, and a second drain electrode, the third thin film transistor has a third gate electrode, a third source electrode, and a third drain electrode, the second gate electrode and the third gate electrode are connected to the scanning line, the second source electrode is connected to the data line, the second drain electrode is connected to the third drain electrode, the third drain electrode is connected to the second pixel electrode, and the third source electrode is connected to the second common line.

13. The liquid crystal display device according to claim 11, wherein:

when the liquid crystal display panel is aligned, the voltage inputted by the second common line is equal to a voltage inputted from the data line, and the voltage inputted by the second common line is not equal to the voltage inputted by the first common line.

14. The liquid crystal display device according to claim 13, wherein the second common line and the data line are grounded.

15. The liquid crystal display device according to claim 11, wherein the voltage of the sub-pixel portion is obtained by a voltage inputted according to the second common line.

16. The liquid crystal display device according to claim 11, wherein the voltage inputted by the second common line is equal to the voltage inputted by the first common line when the liquid crystal display panel is displayed or the liquid crystal display panel is tested.

* * * * *